US006328830B1

(12) United States Patent
Wood et al.

(10) Patent No.: US 6,328,830 B1
(45) Date of Patent: Dec. 11, 2001

(54) METAL OXIDE-FREE 5-AMINOTETRAZOLE-BASED GAS GENERATING COMPOSITION

(76) Inventors: James C. Wood, 1629 Fairway Dr., Moses Lake, WA (US) 98837; Ernest H. Wood, 1483 State Hwy. 161, Fultonville, NY (US) 12072

( * ) Notice: Subject to any disclaimer, the term of this patent is extended or adjusted under 35 U.S.C. 154(b) by 0 days.

(21) Appl. No.: 09/130,838

(22) Filed: Aug. 7, 1998

(51) Int. Cl.[7] ..... C06B 47/08; C06B 31/02; D03D 23/00

(52) U.S. Cl. ..... 149/36; 149/61; 149/109.4

(58) Field of Search ..... 149/36, 61, 109.4; 280/741

(56) References Cited

U.S. PATENT DOCUMENTS

| | | | | |
|---|---|---|---|---|
| 3,645,810 | * | 2/1972 | Genden | 149/43 |
| 3,856,590 | * | 12/1974 | Kincaid et al. | 149/19.8 |
| 5,005,486 | | 4/1991 | Lenzen | 102/531 |
| 5,139,588 | | 8/1992 | Poole | 149/61 |
| 5,160,386 | | 11/1992 | Lund et al. | 149/88 |
| 5,449,423 | | 9/1995 | Cioffe | 149/19.1 |
| 5,460,668 | | 10/1995 | Lyon | 149/36 |
| 5,472,647 | | 12/1995 | Blau et al. | 264/3.1 |
| 5,500,059 | | 3/1996 | Lund et al. | 149/19.1 |
| 5,501,823 | | 3/1996 | Lund et al. | 264/3.1 |
| 5,516,377 | | 5/1996 | Highsmith et al. | 149/18 |
| 5,518,054 | * | 5/1996 | Mitson et al. | 149/35 |
| 5,529,647 | * | 6/1996 | Taylor et al. | 149/2 |
| 5,629,494 | | 5/1997 | Barnes et al. | 149/36 |
| 5,661,261 | | 8/1997 | Ramaswamy et al. | 149/36 |
| 5,670,740 | * | 9/1997 | Barnes et al. | 149/62 |
| 5,731,540 | | 3/1998 | Flanigan et al. | 149/109.6 |
| 5,756,929 | | 5/1998 | Lundstrom et al. | 149/22 |
| 5,773,754 | | 6/1998 | Yamato | 149/36 |
| 5,780,768 | | 7/1998 | Knowlton et al. | 149/36 |
| 5,783,773 | | 7/1998 | Poole | 149/36 |

* cited by examiner

*Primary Examiner*—Charles T. Jordan
*Assistant Examiner*—Aileen J. Baker
(74) *Attorney, Agent, or Firm*—Stratton Ballew PLLC

(57) ABSTRACT

An anhydrous 5-aminotetrazole or "5-AT" based gas generating composition for use in passive restraint devices, such as air bags and a method of preparing the same that is devoid of metal oxides. The gas generating composition includes 5-AT with a blend of oxidizers such as potassium perchlorate and potassium nitrate. This gas generating composition is devoid of metal oxides, such as copper oxide or iron oxide, which form an insoluble slag when ignited. After ignition, the combustion products of the gas generating composition can be filtered with a filter assembly that includes a ceramic blanket. The ceramic blanket preferably includes an aluminum oxide and a silicon oxide.

6 Claims, 2 Drawing Sheets

METAL OXIDE-FREE 5-AMINOTETRAZOLE-BASED GAS GENERATING COMPOSITION

BACKGROUND OF THE INVENTION

The present invention relates generally to a passive restraint system. More specifically, the present invention relates to a gas generating composition which, unlike the current anhydrous 5-aminotetrazole, hereinafter referred to as "5-AT", based gas generating compositions used to inflate passive restraint systems, is devoid of metal oxides.

Gas generating compositions are extremely useful in the automotive passive restraint (air bag) industry, although other uses, such as commercial or military aircraft applications, are contemplated for such gas generating compositions. Today, most, if not all, new automobiles are equipped with single or multiple air bags to protect the driver and passengers. In the operation of air bags, sufficient gas must be generated to inflate the device in a fraction of a second. The air bag must fully inflate between the time that the automobile is impacted in a collision, and the time the driver would otherwise be thrust forward against the steering wheel or a passenger against the dashboard or sideways against the door of a vehicle or aircraft. Subsequently, nearly instantaneous gas generation is required.

There are a number of mandated design specifications of automobile manufacturers and other agencies that must be adhered to in the preparation of gas generating compositions. One such required specification is that the composition produce gas at a specific rate. The automobile manufacturers require that the gas be generated at a sufficiently and reasonably low temperature so that the occupants of the involved automobile are not burned upon impacting an inflated air bag. Inconsistent ballistic output is a major problem with all pyrotechnic inflators. Accordingly, a need exists for a formulation that minimizes the ballistic variability, prevents the production of excessive heat and maintains an adequate burn rate.

Another specification required by the automobile manufacturing industry is that the gas generating composition strictly limits the generation of toxic gases or solids such as carbon monoxide, nitrogen oxide, sulphur oxide, and hydrogen sulfide. Another related design requirement is that the gas generate composition produces a limited quantity of particulate materials, which can interfere with the operation of the passive restraint system, create an inhalation hazard, irritate the skin and eyes, or present a hazardous solid waste that must be disposed of in an environmentally safe manner. Sodium azide is one such hazardous constituent of gas generating compositions that is currently being phased out by the industry due to its high toxicity as taught in U.S. Pat. No. 6,661,261 to Ramaswamy, et al. and U.S. Pat. No. 5,516,377 to Highsmith, et al. Further, the use of sodium azide (or other azides) results in extra expense and risk in manufacture of gas generate due to the extreme toxicity of azides.

It has also been found that the non-azide propellant technologies are costly to manufacture, and have performance problems such as high burn temperature, undesirable trace effluent values and inconsistent ballistic output. High burn temperatures are undesirable because the gas requires more cooling to maintain gas temperatures. Cooling of the gas is typically performed by the inflator filtration system. Increasing the mass of the filter is a common method of cooling the gas. A disadvantage of increasing the mass of the filter is that it also increases material costs. Cool gas temperatures, however, are required to prevent the air bag and subsequently the occupant of the automobile or aircraft from burning. 5-AT is a desirable alternative to using sodium azide in a gas generating composition as taught in U.S. Pat. No. 5,500,059 to Lund, et al.

It is preferable, in any event, to have a gas generating composition which produces more gas and less solids. The nongaseous fraction of the gas generant products must be contained or filtered to provide a clean inflating gas. It is also desirable that when the composition produces particulates, the majority of these particulates are filterable, solid slag. Solid slag is an insoluble metallic particulate that can be easily filtered, preventing the airborne reaction products from escaping into the surrounding environment during and after air bag deployment. Filtration, therefore, serves a function that limits the dissipation of potentially harmful dust in the vicinity of the spent air bag, which could otherwise cause secondary effects to the passengers and others in the vicinity such as eye, lung, and mucous membrane irritation.

Currently available 5-AT based gas generating compositions form a minimum of water soluble products at combustion of the gas generant. U.S. Pat. Nos. 5,500,059 to Lund, et al.; 5,661,261 to Ramaswamy, et al.; 5,516,377 to Highsmith, et al.; 5,501,823 to Lund, et al.; 5,472,647 to Blau, et al.; and 5,139,588 to Poole, all teach the use of transition metal oxides to preferentially form solid slags.

For example, U.S. Pat. No. 5,500,059 to Lund, et al. teaches that copper oxide is a preferred oxidizer in 5-AT based gas generating composition. U.S. Pat. No. 5,139,588 to Poole teaches the use of transition metal oxides and other metal oxides having high melting points in 5-AT based gas generating compositions to function as high temperature slag forming material.

A slag former may be optionally incorporated in the gas generant in order to facilitate the formation of solid particles that may then be filtered from the gas stream. A convenient method of incorporating a slag former into the gas generant is by utilizing an oxidizer or a fuel which also serves in a dual capacity as a slag former.

The current 5-AT based gas generating compositions which also contain metal oxides tend to produce a predominantly insoluble slag at combustion of the gas generant. A predominantly insoluble slag must be filtered with wire mesh due to its harmful side effects. One of the many disadvantages with the use of metal oxides is that if an insoluble slag is not properly filtered for whatever reason, an occupant of the vehicle would likely experience a harmful gritty blast of dust-like particulates at the deployment of the air bag.

On the other hand, if harmless water soluble products are produced at combustion and not filtered properly, the occupant would instead experience a more mild, saline-like spray of substance at air bag deployment. Accordingly, a need exists for a gas generating composition that reduces the levels of harmful insoluble particulates at combustion, resulting in a safer air bag inflator.

Another problem exists at the storage and pelletization stages for current 5-AT based gas generating compositions that contain metal oxides. Metal oxides, such as the preferred oxidizers, copper and iron oxides, cause the tooling used during the pelletization process to frequently be rendered inoperable due to the "gumming up" and abrasive damage to the tooling at the pellet formation stage. Additionally, the storage of these metal oxides creates a considerable housekeeping problem at the manufacturing plant for the gas generating compound. This severe housekeeping problem, due to the powdery and easily disturbed quality of the metal oxide material, is compounded by the potential explosion risk created by airborne metal oxide dust. Safety is a primary concern in the manufacture of gas generating compositions. Metal oxides also create potential environmental concerns due to inhalation hazards, disposal difficulties and potentially toxic effects. Therefore, the elimination of metal oxides has the potential to significantly reduce the safety risks involved in the manufacture of gas generating compositions.

Additionally, metal oxides introduce a source of impurities into the gas generating composition. Metal oxides often contain impurities that cannot be economically separated. These impurities often alter the combustion characteristics of the gas generating compositions in unpredictable ways. Inconsistent combustion is an undesirable quality for any gas generating composition. Elimination of metal oxides results in greater consistency in the combustion products from the gas generating composition.

SUMMARY OF THE INVENTION

The present invention provides an anhydrous 5-aminotetrazole, hereinafter referred to as "5-AT", based gas generating composition that is free of metal oxides. The gas generating composition of the present invention includes 5-AT as a fuel, mixed with an oxidizer. The oxidizer of the present invention includes a blend of two oxidizing compounds, most preferably, a blend of potassium perchlorate ($KClO_4$) and potassium nitrate ($KNO_3$).

The gas generating composition as formulated in the present invention does not include conventionally utilized metal oxides. Metal oxides typically utilized in 5-AT propellants include copper oxide (CuO) or iron oxide ($Fe_2O_3$). These metal oxides are utilized in 5-AT fueled propellants to reduce the formation of an insoluble "slag." Slag is an undesirable by-product of propellant combustion. Conventionally, slag is retained within the filter of the inflator. The filter is conventionally a metallic mesh having fine openings that entrap the solid slag particles and prevent them from escaping into the air bag. In the inflator of the present invention, the metal mesh filter is supplemented with a ceramic filter. The ceramic filter is preferably a silicon oxide and aluminum oxide blend.

The fuel used in the gas generating composition of the present invention is 5-AT. Because of 5-AT's high nitrogen content and the fact that it only contains one carbon atom, 5-AT is advantageous as a fuel for non-azide gas generating compositions.

In accordance with the present invention, the 5-AT fuel and the oxidizers are combined and mixed in a predetermined stoichiometric ratio. The selection of oxidizers were achieved by the experience and knowledge of the present inventors in the field of the present invention.

Standard mixing equipment for mixing energetic solids of these types that are well known to those who have skill and knowledge of this art is utilized in the manufacture of the gas generating composition of the present invention.

When a gas generating composition included a combination of 5-AT and a metal oxide, it was observed that significant quantities of "slag" was formed. The term slag is herein defined as insoluble metallic particulate. This slag was generated in addition to the gasses generated by the ignition of the gas generating composition containing the metal oxide.

It is, therefore, an advantage of the present invention to provide a gas generating composition that is devoid of metal oxides.

Another advantage of the present invention is to provide a gas generating composition that produces an acceptable level of undesirable trace effluents such as carbon monoxide, and nitric oxide, which are inherently present in nonazide gas generating compositions.

A further advantage of the present invention is to provide a gas generating composition that minimizes the ballistic variability through the inherent consistency in the formulation of the gas generating composition of the present invention.

A related advantage of the present invention is to minimize potential flash detonation of airborne metal oxide dust in the pelletization stage thereby increasing safety and reducing incidences of injury.

Another advantage of the present invention is to provide a gas generating composition that results in environmentally friendly water soluble products of combustion, such as potassium salt.

Another advantage of the present invention is to provide a gas generating composition that is environmentally friendly after the deployment of the gas generant.

A further advantage of the present invention is to provide a gas generating composition that minimizes abrasive damage to the tooling used at the pelletization stage in the manufacture of the gas generating composition for use in a passive restraint system.

An additional advantage of the present invention is to provide a gas generating composition that yields 98 volume percent of inert nonhazardous gases.

A still further advantage of the present invention is to provide a gas generating composition that has higher gas yields which permit a smaller inflator and a smaller, less expensive filter to be utilized in an air bag.

Another advantage of the present invention is to provide a gas generating composition that has a significantly lower bum temperature than conventional nonazide compositions.

An additional advantage of the present invention is to provide a gas generating composition that can be mass produced using a dry or wet manufacturing process.

A further advantage of the present invention is to provide an improved method for making a passive restraint system.

Additional features and advantages of the present invention are described in and will be apparent from the detailed description of the presently preferred embodiments and from the drawings.

DETAILED DESCRIPTION OF PREFERRED EMBODIMENTS

The present invention provides an inflator which includes a gas generating composition that is formulated to minimize the yield of noxious metallic effluents.

Figure 1:
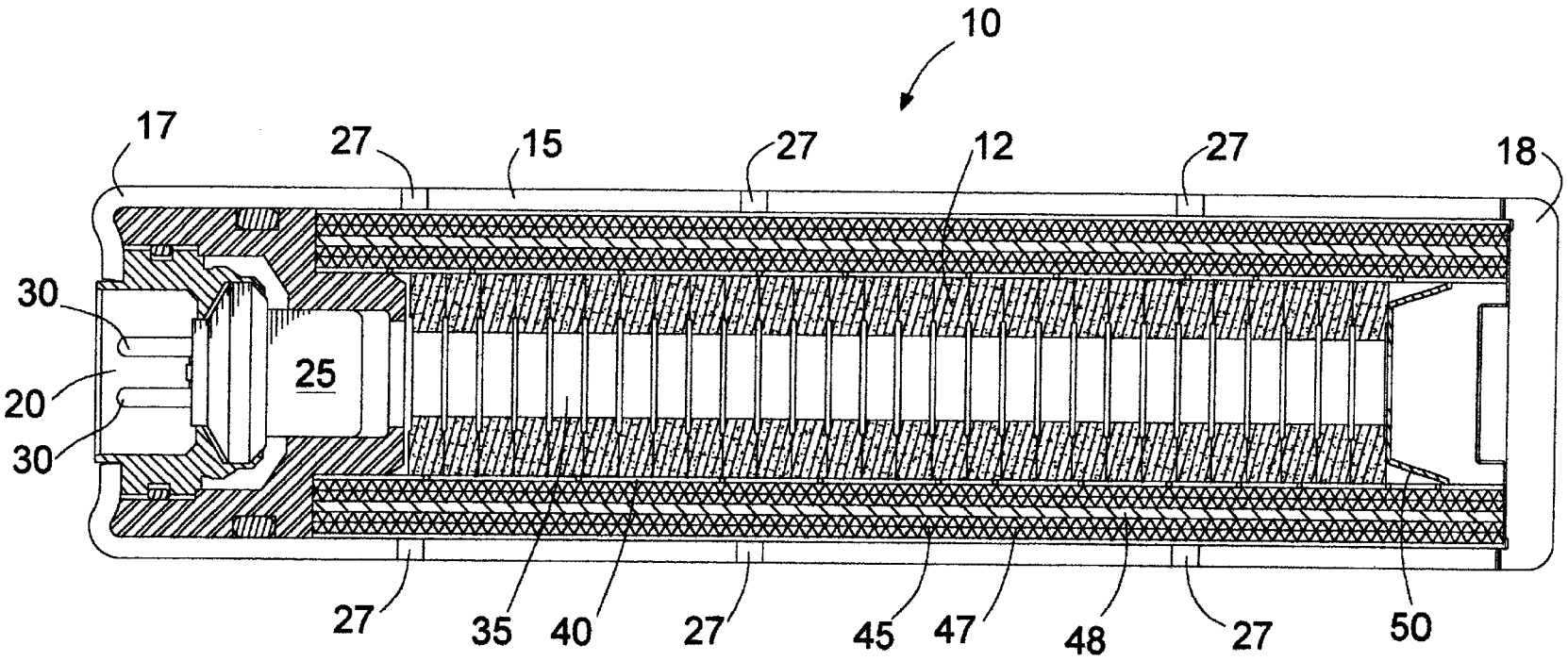
FIG. 1 is a partially sectioned view of a gas generating device in accordance with a preferred embodiment of the invention.

As shown in FIG. 1, an exemplary gas generating device 10 is shown which may be employed with a gas generating composition 12 of the present invention, contained within. The gas generating device includes a body 15 that encases the gas generating device. The body has a first end 17 and a second end 18. The first end of the body includes an aperture 20 for receiving an initiator assembly 25. The body preferably also includes a plurality of apertures 27 to allow the gas generated within to escape into an inflating air bag (not shown).

To ignite and combust the gas generating composition 12, a crash sensor (not shown) closes an electrical circuit, or initiates a firing signal which activates the initiator assembly 25. The initiator assembly contains a small explosive charge (not shown) or pyrotechnic composition designed to produce a heat flash of sufficient intensity to ignite the gas generating composition. The initiator also includes two electrodes 30, each insulated from one another and connected by a bridge wire (not shown). The bridge wire is preferably embedded in the small explosive charge. The inventors preferably utilize zirconium potassium perchlorate (ZPP) as the small explosive charge within the initiator assembly. However, any such pyrotechnic material known to those who have skill and knowledge in this art could be used.

Furthermore, as also shown in FIG. 1, the exemplary gas generating device 10 also includes a central core cavity 35 through the gas generating composition 12 contained within. The initiator assembly 25 ignites the gas generating composition by sending a heat flash down the central core cavity to contact and ignite the gas generating composition. The gas generating composition is contained proximate to the core of the gas generating device and is surrounded by a perforated tube 40 of a low carbon steel.

Wrapped around the perforated tube 40, a filter assembly 45 is received. The filter assembly includes a minimum of a mesh filter 47 and a ceramic blanket 48. The mesh filter is preferably fabricated from a metal screen of low carbon steel and a fine mesh of approximately 20 holes per inch. The ceramic blanket is preferably a conventional glass filter, and most preferably an aluminum oxide and silicon dioxide media, having a permeability of approximately 24 CFM/$FT^2$, an average thickness of approximately ⅛ inch, a "total shot" of approximately 43% and an LOI of approximately 4%. "361-Z" ceramic paper material, as manufactured by Thermal Ceramics of Augusta, Ga., is preferred.

The mesh filter 47 preferably sandwiches the ceramic blanket 48. The filter assembly 45 is preferably wound onto the perforated tube 40 to achieve the layering as shown in FIG. 1. The mesh filter preferably sandwiches the ceramic blanket and acts as a protective support structure for the more fragile ceramic blanket. The filter assembly shown in FIG. 1 includes a single layer of ceramic blanket between layers of mesh filter. Most preferably, as employed in the example included herein, an additional outer layer of mesh filter is provided, thereby bringing the total number of mesh layers to three.

Figure 3:
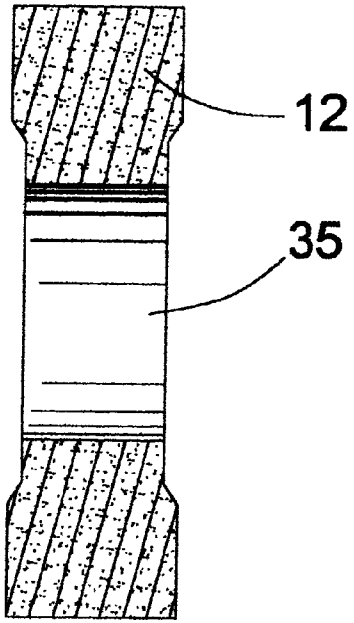
FIG. 3 is a sectioned view of the solid geometric form of a gas generating composition, taken along section line 3—3 of FIG. 2.
Figure 2:
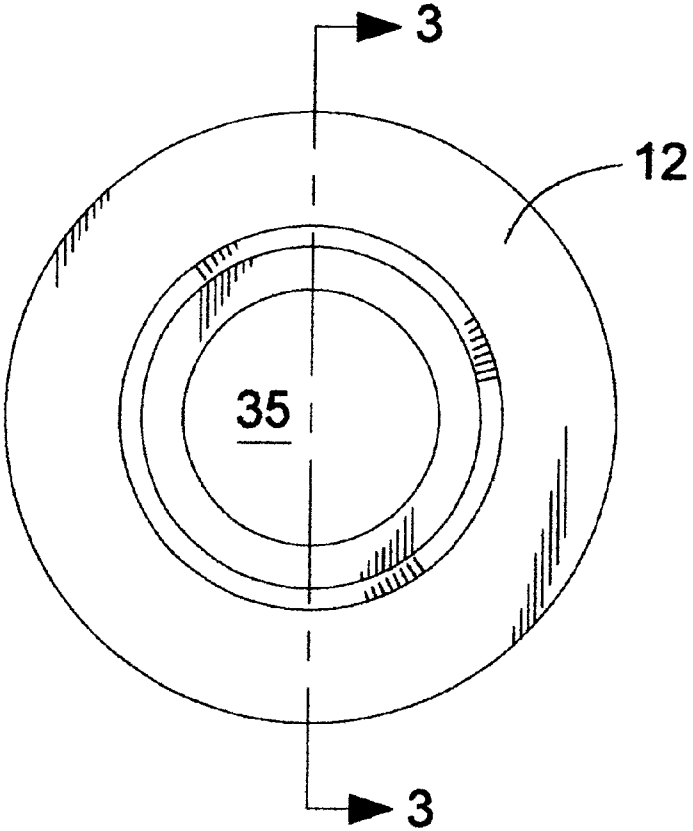
FIG. 2 is a top view of a solid geometric form of a gas generating composition in accordance with a preferred embodiment of the invention.

FIG. 2 shows a solid form of the gas generating composition 12 in a geometric shape that is preferred for use in the exemplary gas generating device 10, shown in FIG. 1. The preferred geometric shape as shown in FIG. 2 includes the central core cavity 35 for receiving the heat flash from the initiator assembly 25. FIG. 3 shows a section of the preferred geometric shape of the gas generating composition of FIG. 2, which is similar to the view shown in FIG. 1. The preferred geometric shape of the gas generating composition is stacked together within the gas generating device as detailed in FIG. 1. The geometric shape's physical parameters, such as the exact diameter, thickness, and size of the central core cavity can be varied to suit the specific qualities of the desired dynamics for combustion and gas generation, as required.

As also detailed in the exemplary gas generating device 10 shown in the FIG. 1, preferably, a propellant retainer 50 maintains the position of the gas generating composition 12 until the gas generating device is fired. When ignited, the rapidly expanding gas from the gas generating composition escapes through the perforated tube 40, and then through the filter assembly 45, to finally emit from the plurality of apertures 27 in the body 15 of the gas generating device. An air bag (not shown) or a similar device can then be quickly inflated with the gas thus generated.

The following example illustrates the gas generating compound 12 of the present invention. This gas generating compound as specified by this example is illustrative of the invention, but not specifically limiting. This example was performed by igniting the gas generating compound within the exemplary gas generator 10 as described herein. Furthermore, a test device was configured that included the exemplary gas generator mounted to expel the gas generated into a 60 liter tank.

EXAMPLE 1

A gas generating composition containing 45% 5-AT (7.7 g), 12% $KClO_4$(2 g), and 43% (7.3 g) $KNO_3$ was prepared by a standard dry process. The process included mixing the above listed components, followed by compaction and screening and finally pressing into formed pellets, preferably in the form as shown in FIG. 2, by processing in an auger type aspirin press, modified to form the preferred pellet. The formed pellets were tested by combusting a multiple pellet charge in the test device as previously described herein. The test device included 90 mg ZPP within the initiator of the gas generator within the test device. After ignition and burning, gaseous products of the combustion were analyzed. The 30 minute time averaged concentrations of the gaseous samplings in ppm by volume, which are set forth in Table I below, as determined by infrared spectroscopy:

TABLE I

| | |
|---|---|
| Carbon Monoxide | 168 |
| Carbon Dioxide | 999 |
| Nitric Oxide | <1 |
| Nitrogen Dioxide | <1 |
| Nitrous Oxide | <1 |
| Ammonia | <1 |
| Hydrogen Cyanide | <2 |
| Methane | <1 |
| Benzene | <3 |
| Ethanol | <2 |
| Formaldehyde | <5 |
| Hydrogen Chloride | <1 |
| Phosgene | <1 |
| Other Hydrocarbons | <5 |
| Surfer Dioxide | <1 |

Additionally, a small amount of slag and soluble solids were formed as condensable combustion products. Roughly 90% of the condensable combustion products included potassium chloride and sodium chloride, both present as water soluble solids. The remaining 10% of the condensable combustion products includes insoluble slags, which predominantly comprise carbonized grit.

As a refinement to the above example, the following Example 2 is a proposed formulation for a gas generating composition 12 that is expected to reduce the level of carbon monoxide as found in the gaseous combustion products.

EXAMPLE 2

In this proposed example, approximately 38% 5-AT, approximately 12% $KClO_4$, and approximately 50% $KNO_3$ would be processed and inserted into the gas generator device, as described in reference to Example 1, above. The reduction in 5-AT, the source of carbon in the gas generating composition, should result in a significant reduction of the resultant levels of carbon monoxide in the gaseous products of combustion. Additionally, to aid in the processing and forming of the gas generating composition, the addition of approximately 1% magnesium stearate would be most preferably included in the gas generating composition, with minimal effect on the combustion products evolved after ignition.

Also, as an alternative to the process performed in Example 1 or as the proposed modification in Example 2, a conventional wet forming process could be employed to form the preferred formed pellets of FIG. 2. Additionally, other geometric forms of the gas generating composition could be utilized, especially when the gas generator device is specifically configured to accommodate a varied form. Powdered or granular forms are also considered as alternatives to the preferred formed pellet.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible which employ the same inventive concepts as described above. Therefore, the invention is not to be limited except by the following claims, as appropriately interpreted in accordance with the doctrine of equivalents.

What is claimed is:

1. A metal oxide free, gas generating composition comprising in combination, by weight, approximately 38% 5-aminotetrazole, approximately 12% potassium perchlorate, approximately 50% potassium nitrate, and absent metal oxides.

2. The metal oxide free, gas generating composition of claim 1 further comprising, by weight, approximately 1% magnesium sterate.

3. A metal oxide free, gas generating composition comprising in combination, by weight, approximately 45% 5-aminotetrazole, approximately 12% potassium perchlorate, approximately 43% potassium nitrate, and absent metal oxides.

4. The metal oxide free, gas generating composition of claim 1 further comprising, by weight, approximately 1% magnesium sterate.

5. A gas generating composition consisting of, in combination by weight, approximately 38% to 45% 5-aminotetrazole, approximately 12% potassium perchlorate, and approximately 43% to 50% potassium nitrate.

6. The gas generating composition of claim 5 further consisting of, by weight, of approximately 1% magnesium stearate.

* * * * *